United States Patent [19]

Schiefen et al.

[11] Patent Number: 4,829,147

[45] Date of Patent: May 9, 1989

[54] CIRCUIT BREAKER WITH POSITIVE CONTACT INDICATION

[75] Inventors: Daniel R. Schiefen; John M. Winter, both of Cedar Rapids, Iowa

[73] Assignee: Square D Company, Palatine, Ill.

[21] Appl. No.: 922,968

[22] Filed: Oct. 24, 1986

[51] Int. Cl.[4] ..... H01H 3/00

[52] U.S. Cl. ..... 200/17 R; 200/DIG. 42; 200/401; 335/166

[58] Field of Search ..... 200/DIG. 42, 153 G, 200/17 R; 335/166

[56] References Cited

U.S. PATENT DOCUMENTS

| | | | |
|---|---|---|---|
| 3,525,959 | 8/1970 | Ellsworth et al. | 200/DIG. 42 X |
| 4,129,762 | 12/1978 | Bruchet | 200/DIG. 42 X |
| 4,165,453 | 8/1979 | Hennemann | 335/166 X |

*Primary Examiner*—A. D. Pellinen
*Assistant Examiner*—Morris Ginsburg
*Attorney, Agent, or Firm*—M. R. Jankousky; T. B. Lindgren

[57] ABSTRACT

A circuit breaker having positive contact indication. Upon the circuit breaker tripping, the operating mechanism components unlatch, moving the cradle, upper link and lower link upwards and opening the contacts. Upon the circuit breaker being manually opened, no operating mechanism components move except the upper link and lower link which causes the contacts to open. Upon the occurrence of locked contacts and the operating mechanism receiving a trip signal, the operating mechanism components unlatch but move only slightly since the contacts cannot open. A shuttle, pivotally mounted on the cradle, moves upward slightly to catch its tail on a flipper spring. The shuttle rotates slightly to meet a tab positioned on the handle arm and to block and opening movement of the operating handle.

9 Claims, 8 Drawing Sheets

CIRCUIT BREAKER WITH POSITIVE CONTACT INDICATION

FIELD OF THE INVENTION

The present invention relates in general to circuit breakers and more particularly is directed to a circuit breaker with positive contact indication.

CROSS REFERENCE TO RELATED APPLICATION

The present invention is related to material disclosed in the following copending U.S. applications, all of which are assigned to the same assignee of the present application and are herein incorporated by reference:

Ser. No. 922,966, entitled "Circuit Breaker Arc Stack Assembly" filed Oct. 24, 1986 by J. M. Winter;

Ser. No. 922,577, entitled "Trident Arc Horn for Circuit Breaker" filed Oct. 24, 1986 by A. A. Maulandi, K. J. Green, G. A. Volesky;

Ser. No. 922,576, entitled "Circuit Breaker Contact Assembly" filed Oct. 24, 1986 by J. M. Winter;

Ser. No. 922,967, entitled "Circuit Breaker Trip Solenoid Assembly" filed Oct. 24, 1986 by J. M. Winer, R. F. Dvorak;

Ser. No. 922,575, entitled "Electronic Circuit Breaker with Withstand Capability" filed Oct. 24, 1986 by J. M. Winter.

BACKGROUND OF THE INVENTION

Circuit breakers are designed to open their contacts either upon manual operation or upon the occurrence of an overcurrent. Contacts occasionally refuse to open as expected and lock in the closed position. Certain standards applicable to circuit breakers sold in some countries require that in the event of locked contacts, the operating handle should generally indicate ON. Although locked contacts are a relatively rare occurrence, they create a potentially hazardous situation because the circuit breaker has operated in an unexpected manner. Current is flowing through at least one phase of the circuit breaker when the operator or maintenance personnel has reason to expect that the circuit breaker has opened and has interrupted the current. Maintenance personnel May check the circuit breaker handle and find that it indicates open contacts and then begin working on nearby electrical equipment or on the circuit breaker itself.

In the prior art this problem was remedied by a circuit breaker mechanism, which upon the contacts being locked together, could not be moved from the ON position or moved back to the ON position after being manually moved away. The operating handles of these designs indicate when there is current flowing through the circuit breaker. However, these designs do not alert personnel to the fact that the contacts are locked. Maintenance personnel may only know that the contacts are closed and will expect the circuit breaker to interrupt the current should a fault later occur.

SUMMARY OF THE INVENTION

Accordingly, an object of the present invention is to provide a circuit breaker that positively indicates the position of the contacts.

The circuit breaker of the present invention comprises a pair of separable contacts and an operating mechanism for opening and closing the contacts by manual movement of the operating handle or by tripping the circuit breaker.

In the event of locked contacts and the circuit braker being signalled to trip, the mechanism will unlatch. However, the contacts will remain closed. If an operator then attempts to move the operating handle to the open or OFF position, a shuttle, pivoted on the operating mechanism, will rotate upwards to block the movement of the handle to the OFF position. The circuit breaker contacts cannot be reclosed since the operating handle must be moved beyond the OFF position to reset the operating mechanism before returning the operation handle to the ON position.

The shuttle is pivotally connected to the cradle which moves upwards during a tripping operation. When the circuit breaker trips, the cradle, shuttle and flipper move upwards past the flipper spring to the tripped position. When the operating mechanism unlatches but the circuit breaker is prevented from tripping because of locked contacts, the flipper catches on the flipper spring to rotate the flipper and shuttle upwards to an approximately horizontal position. A tab on the inside of the operating handle contacts the shuttle and the operating handle cannot be moved to the OFF position.

BRIEF DESCRIPTION OF THE DRAWINGS

The present invention will become more readily apparent from the following description of the preferred embodiments of the present invention taken in conjunction with the accompanying drawings, in which:

FIG. 11 is a partial bottom view of the moving contacts and arc horn taken along lines 11—11 of FIG. 1.

DESCRIPTION OF THE INVENTION

Figure 1:
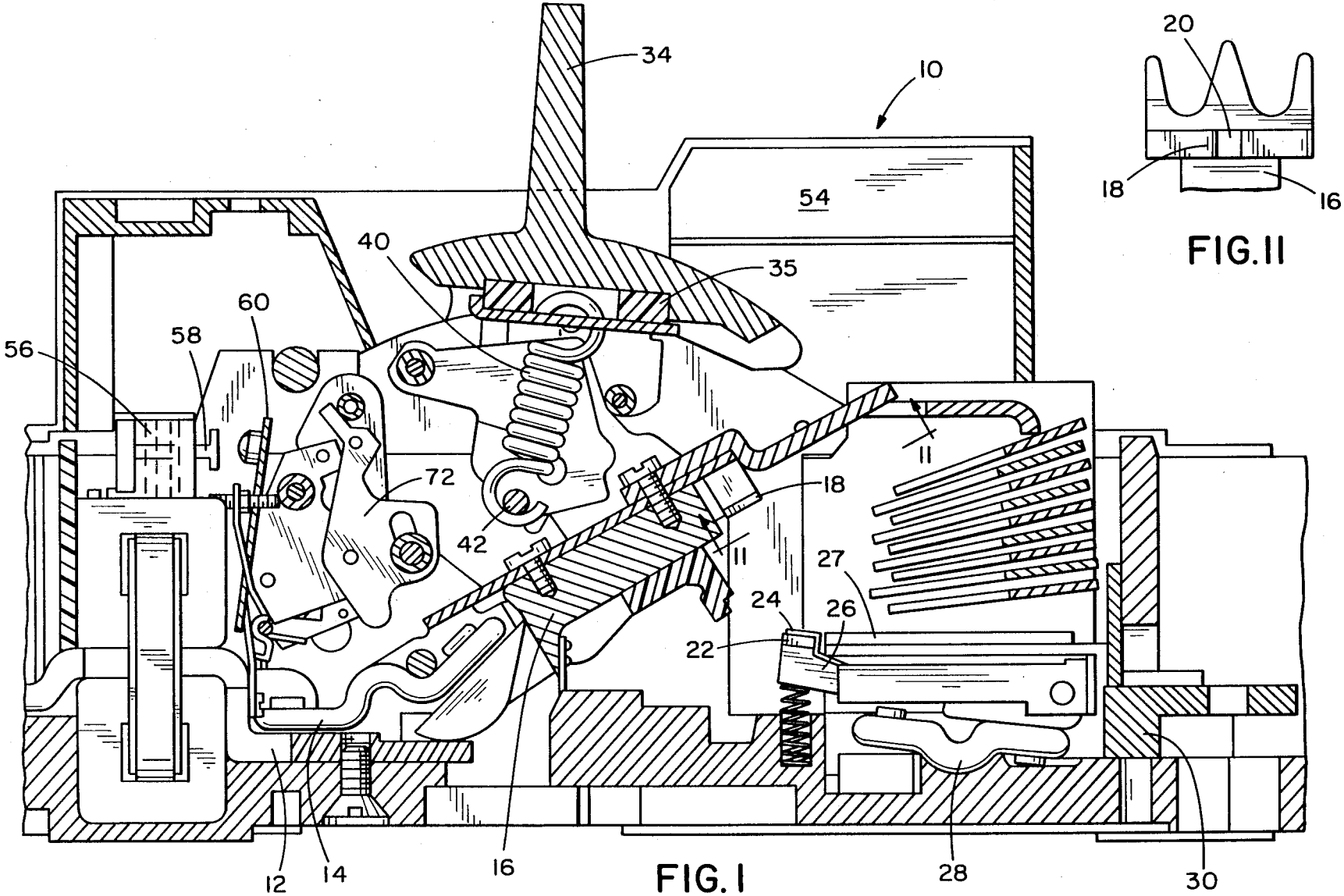
FIG. 1 is a side view of the circuit breaker in the tripped position.

Referring now to the drawings and in particular to FIGS. 1 and 11, a circuit breaker, indicated generally as 10, is shown. The current path through the circuit breaker 10 is via the load terminal 12, load side flexible connector 14, upper blade 16, moving main contact 18, moving arcing contact 20, lower main contact 22, lower arcing contact 24, lower main blades 26, lower arcing blade 27, line side flexible connector 28 and line terminal 30.

Figure 2:
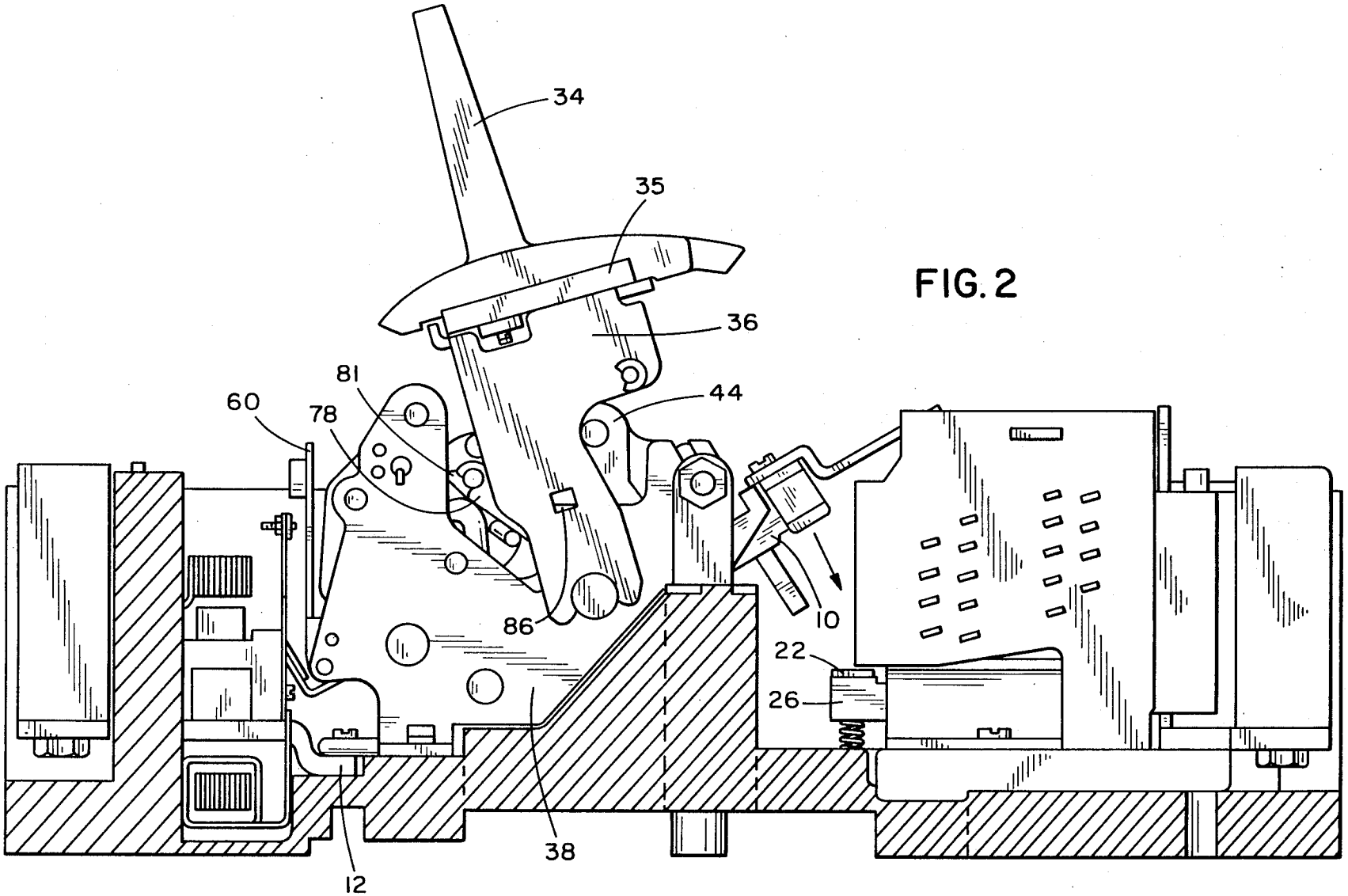
FIG. 2 is a side view of a portion of the circuit breaker in the open position.
Figure 3:
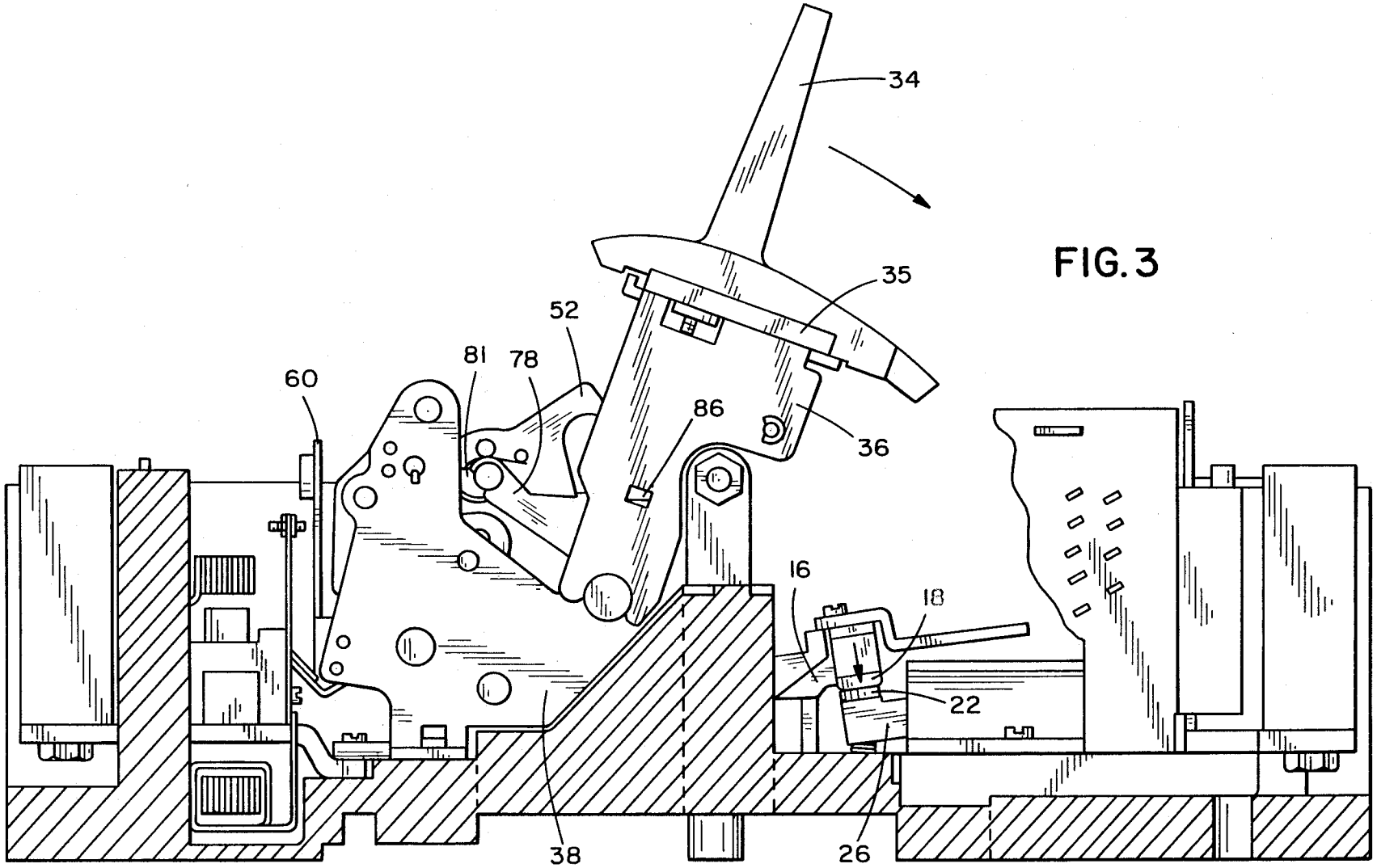
FIG. 3 is a side view of a portion of the circuit breaker in the closed position.
Figure 4:
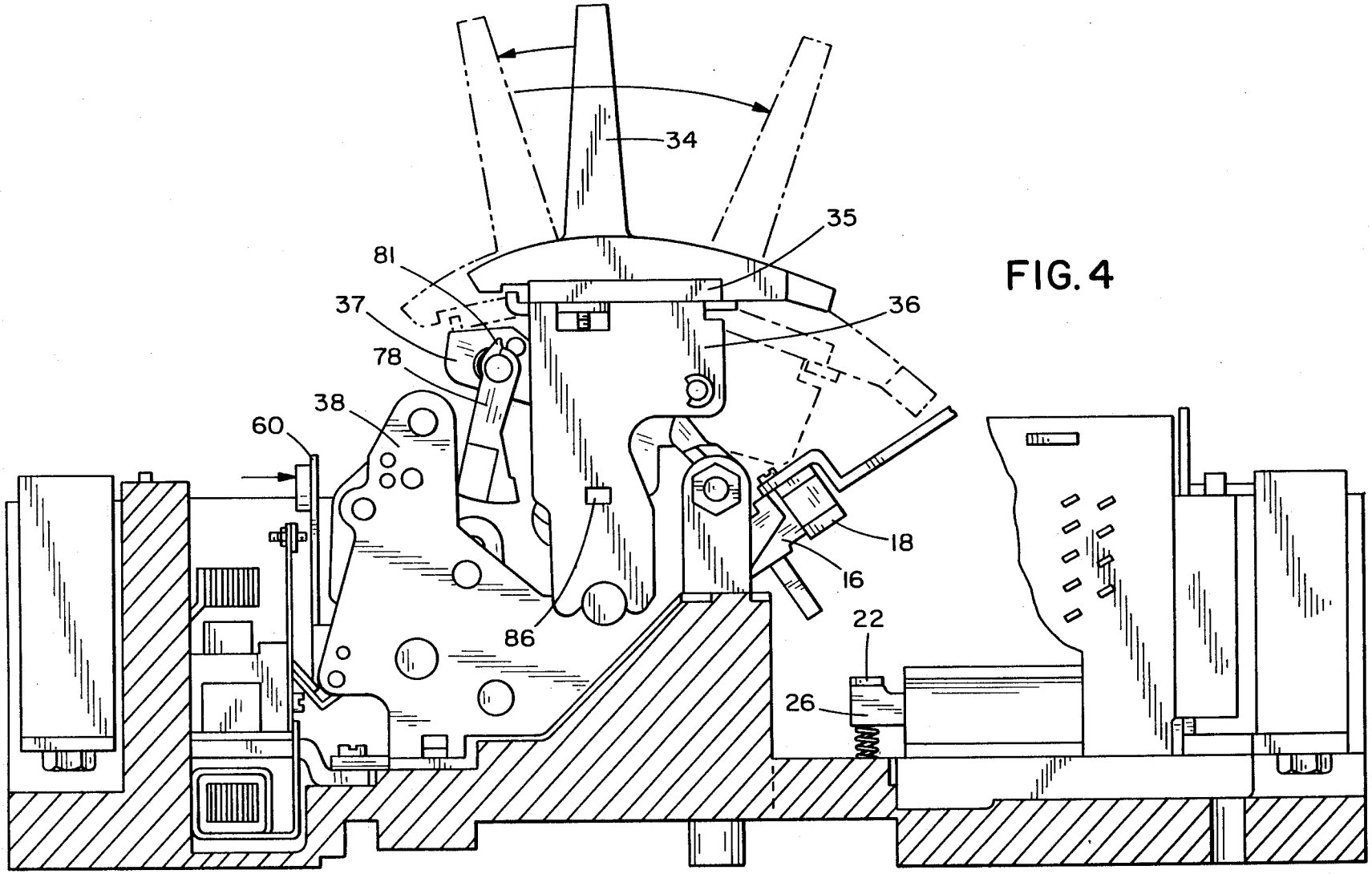
FIG. 4 is a side view of a portion of the circuit breaker in the tripped position, with phantom views of the handle in the closed and open position.
Figure 7:
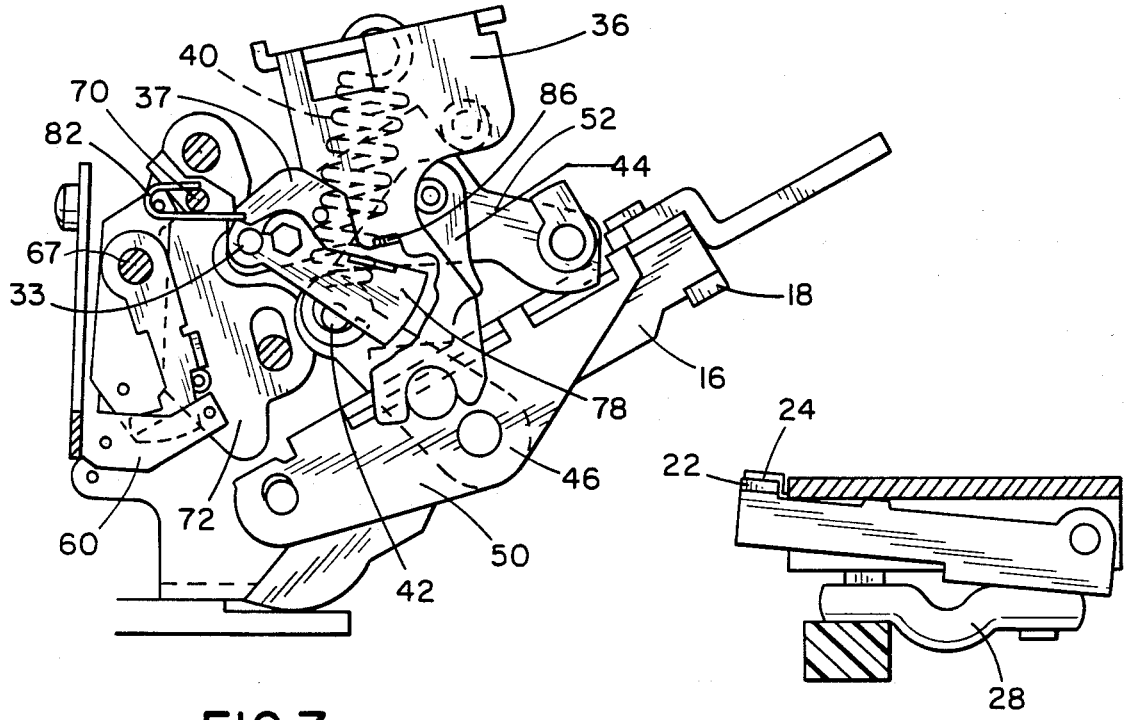
FIG. 7 is a side view of a portion of the operating mechanism and contact assembly in the open position.
Figure 8:
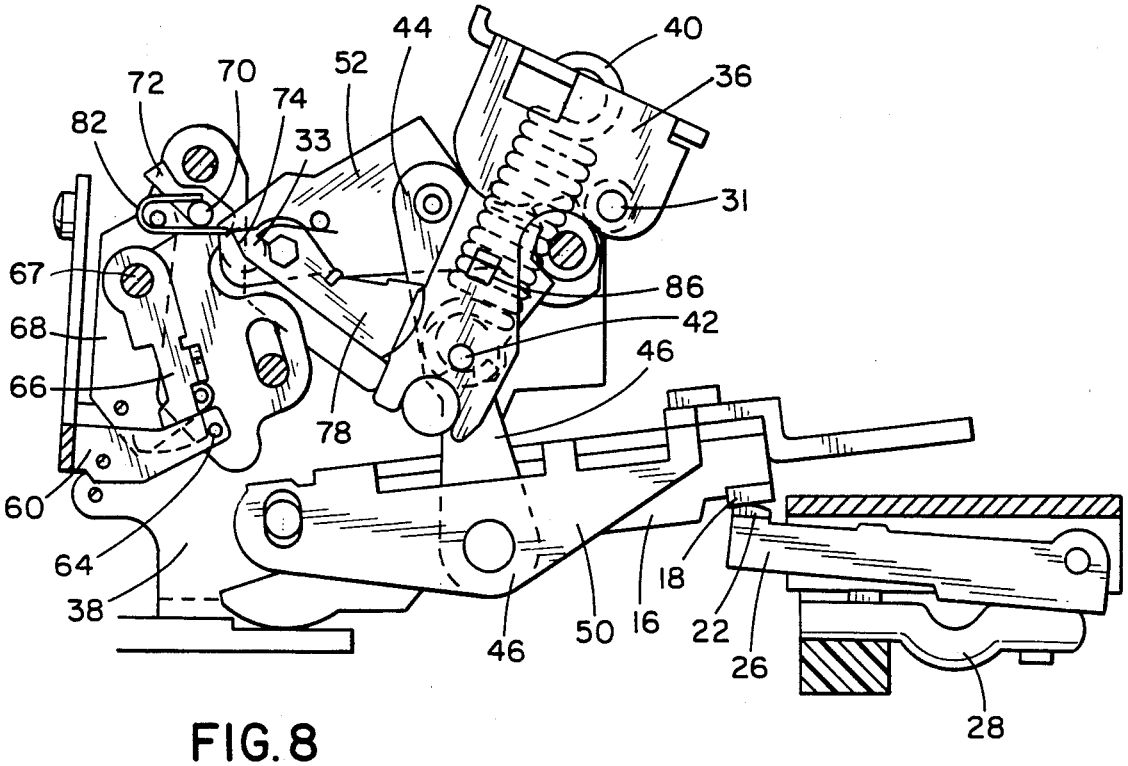
FIG. 8 is a side view of a portion of the operating mechanism and contact assembly in the closed position.

The circuit breaker contacts may be moved from the closed position, as shown in FIGS. 3 and 8, to the open position, as shown in FIGS. 2 and 7, by moving the operating handle 34 to the left as shown in those Figures. The operating handle 34 is mounted on a handle arm 36 which pivots about the mechanism side frame 38. A toggle spring 40 connected between the handle arm 36 and the link pin 42 causes the contacts to open when the toggle spring passes the over center position of the upper link 44 and lower link 46. The lower link is connected to the upper blade carrier 50 which is solidly connected to the upper blade 16. The upper link 44 and lower link 46 are pivotally connected by the link pin 42, while the upper end of the upper link 44 is connected to the cradle 52 or first member. When the breaker is manually opened, even though the upper link 44 and lower link 46 collapse the cradle 52 does not move.

When the circuit breaker is signalled to trip, either because of an overcurrent or other trip signal, the electronic trip assembly, located in cavity 54 of the circuit breaker cover, energizes the trip coil 56 causing the plunger 58 to extend and hit the trip lever 60. A description of a trip assembly may be found in a co-pending U.S. application, Ser. No. 720,235, "Microcomputer-Based Electronic Trip Unit for A Circuit Breaker" filed Apr. 5, 1985 by J. C. Chiang and W. P. Hooper.

Upon the plunger 58 hitting the trip lever 60, the trip lever 60 rotates clockwise, allowing the trip lever pin 64 to release the secondary latch 66. The secondary latch 66 and quick trip latch 68 rotate counterclockwise (because both th secondary latch 66 and quick trip latch 68 are physically connected to the same shaft 67) releasing the cradle latch roller 70 and allowing the cradle latch 72 to rotate counterclockwise. The cradle roller 74 then moves upwards as the cradle 52 rotates clockwise, pulling the upper link 44, lower link 46 and upper blade carrier 50 upwards to separate the moving contacts from the lower contacts or second contacts.

Figure 6:
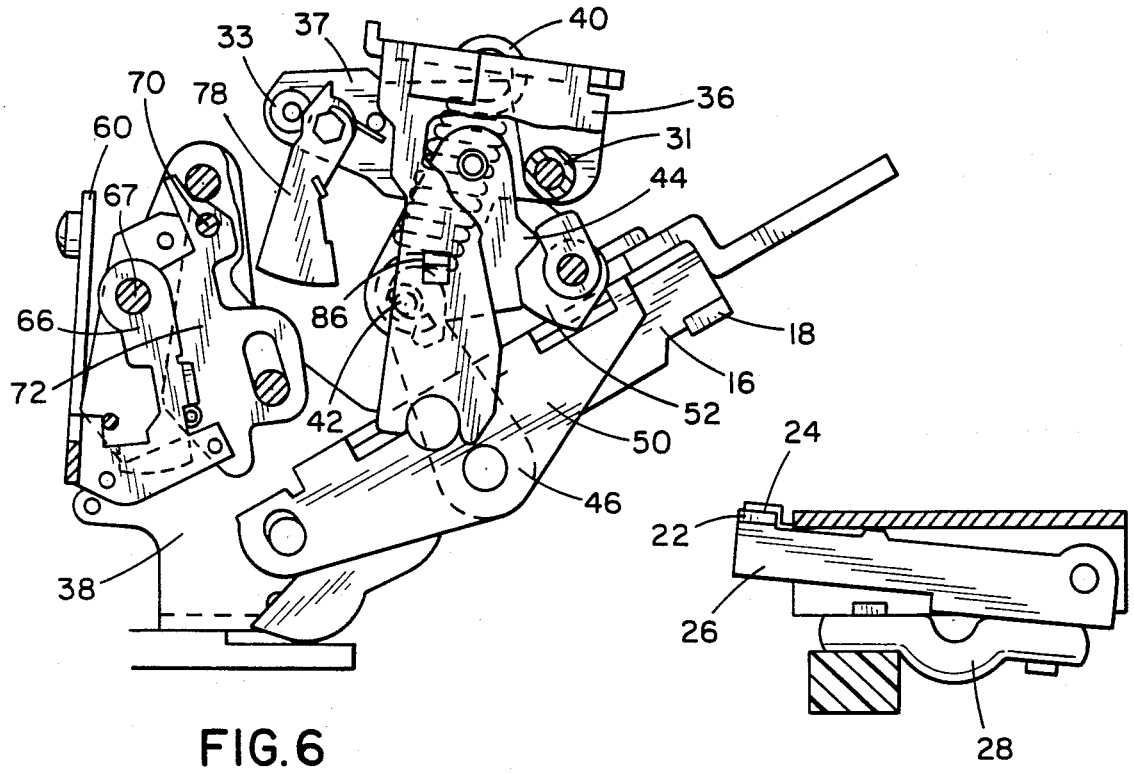
FIG. 6 is a side view of a portion of the operating mechanism and contact assembly in the tripped position.

A shuttle 78 is pivotally connected to the cradle 52 about cradle end 37. As the cradle 52 moves upward during a tripping operation, the shuttle moves upward also. Cradle roller 31 rolls on a straight line on cradle 52, which in turn rotates the cradle 52 counterclockwise until cradle roller 33 contacts the cradle latch 72 (as cradle 52 latches with the cradle latch 72), and cradle roller 33 moves the cradle latch 72 out of the way until the cradle latch 72 latches with cradle 52. Solidly connected to the shuttle 78 is a flipper 80 having a tail 81 that contacts a U-shaped flipper spring 82 during tripping operations. The flipper spring 82 is connected to the mechanism side frame 38. During a normal tripping operation the flipper 80 and shuttle 78 pass through the flipper spring 82 to the position shown in FIG. 6.

When the circuit breaker contacts are locked and the circuit breaker receives a signal to trip, the trip lever 60 rotates to unlatch the operating mechanism. The tolerances in the operating mechanism allow the cradle 52 to move slightly upwards. The flipper tail 81 engages the flipper spring 82, causing the shuttle 78 to rotate upwards to an approximately horizontal position.

Figure 5:
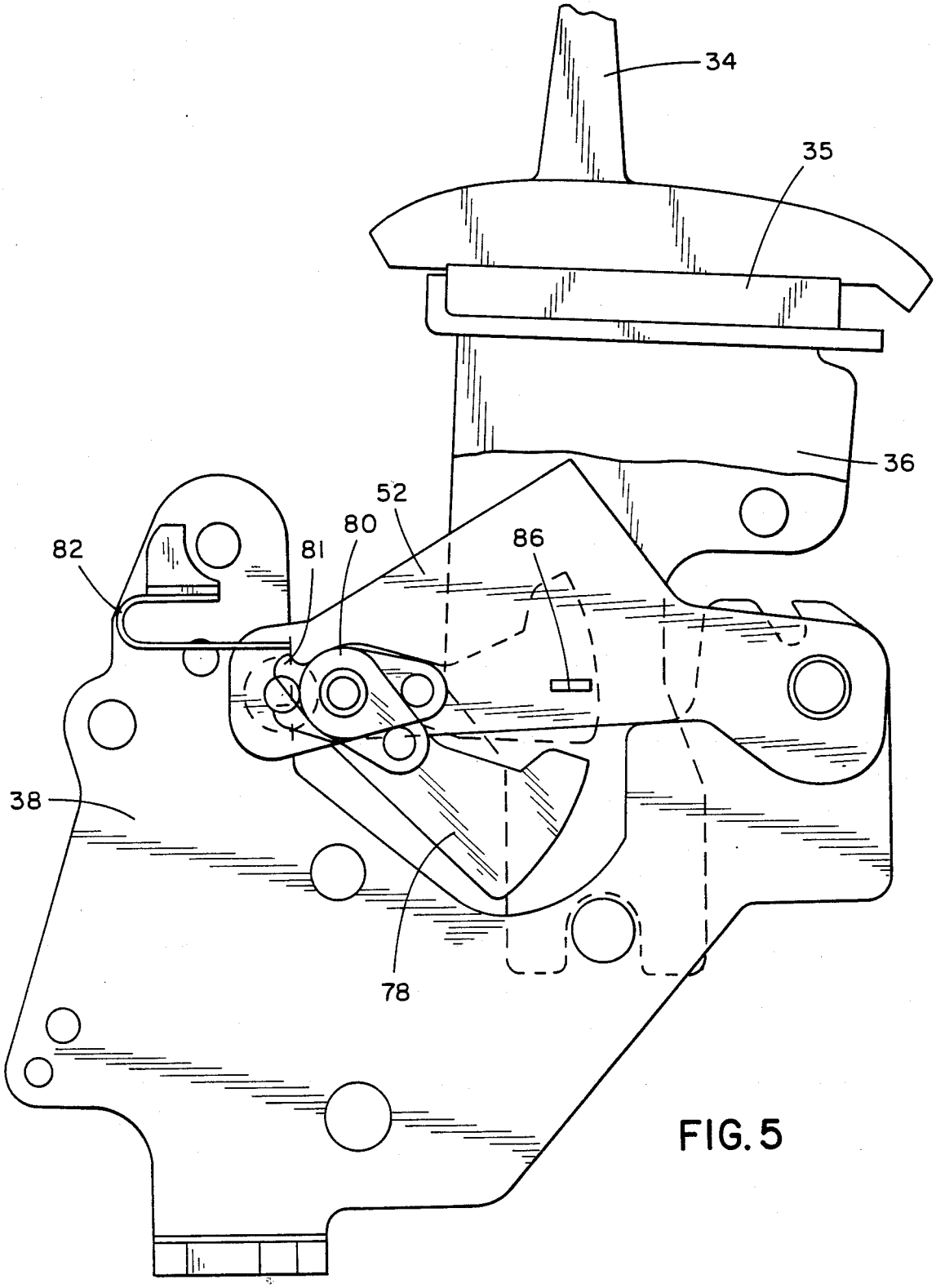
FIG. 5 is a side view of a portion of the linkages of the operating mechanism, showing the shuttle in the dotted line position as activated by locked contacts.
Figure 9:
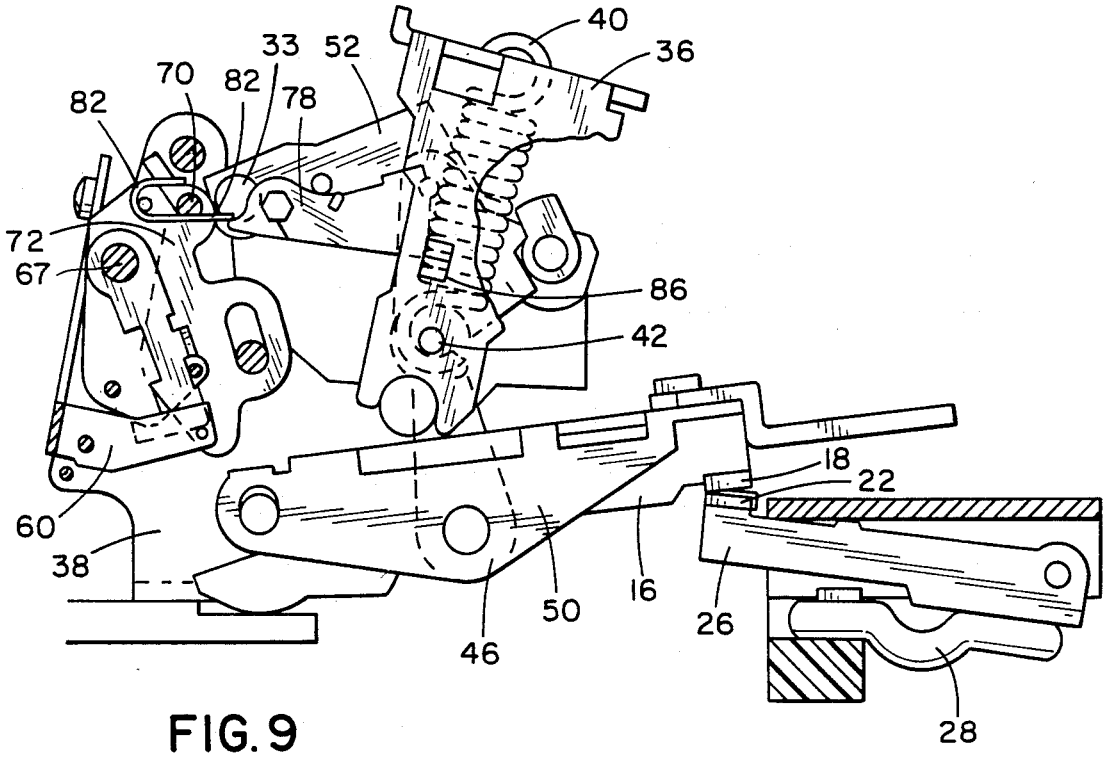
FIG. 9 is a side view of a portion of the operating mechanism and contact assembly in the locked position.
Figure 10:
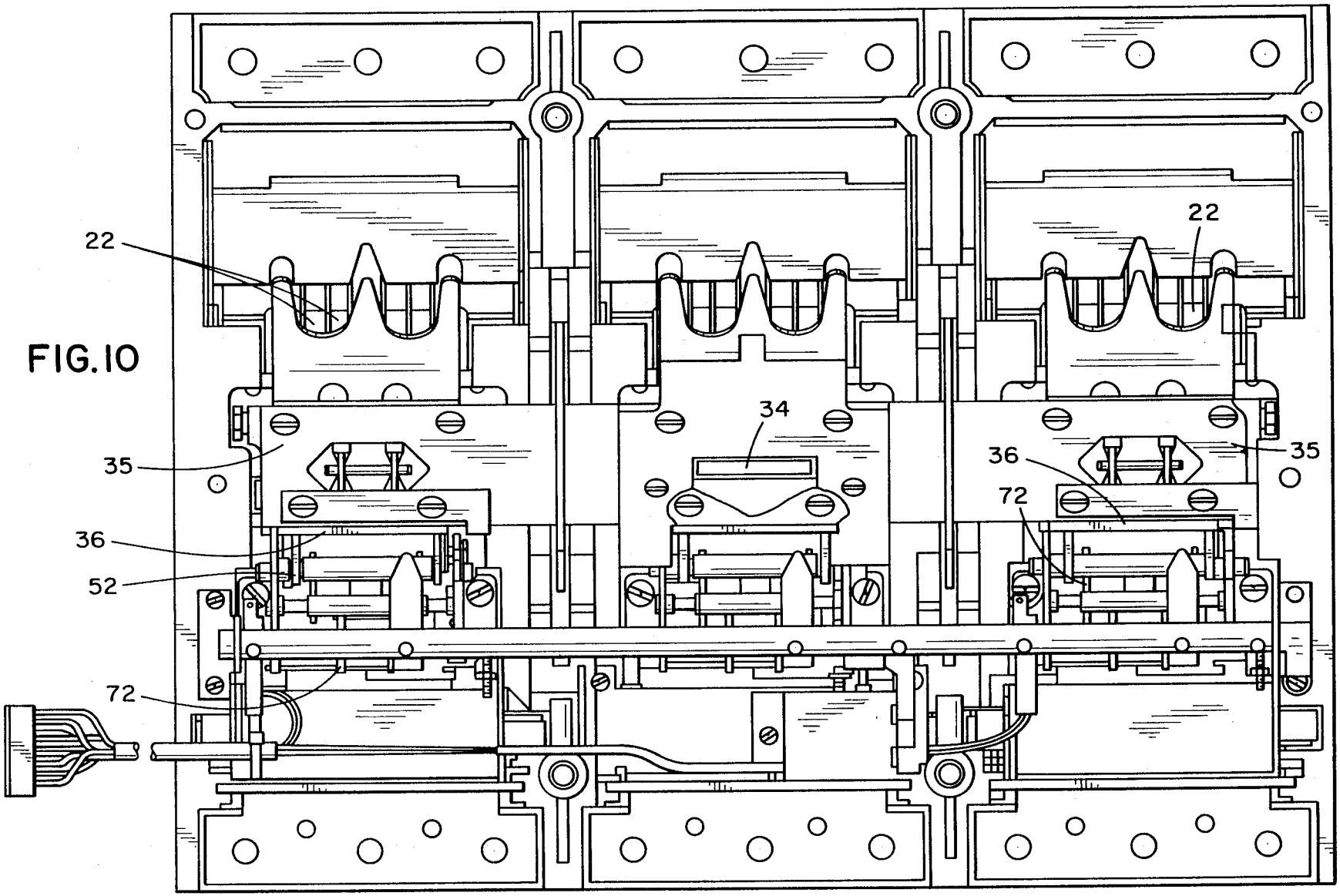
FIG. 10 is a top view of the circuit breaker with the cover removed in the tripped position.

If an attempt is then made to manually open the circuit breaker, a tab 86 on the inside of the handle arm 36 is forced against the shuttle 78 as shown in FIGS. 5 and 9. The circuit breaker contacts cannot be moved to the open position because the movement of the handle arm 36 is blocked by the shuttle 78. Neither can the circuit breaker be returned to the closed position because the operating mechanism cannot be reset until the operating handle 34 is moved to the left past the manually open position as shown in FIG. 7. Thus maintenance personnel have an indication that the circuit breaker contacts are locked. The operating handle will be located between the closed position and the tripped position.

The present invention is described as applied to a three phase circuit breaker. Each phase of the circuit breaker has a separate operating mechanism. The handle arm 36 of each of the operating mechanisms is joined to the others by a rod or handle tie bar 35 so that all mechanisms essentially move simultaneously. The circuit breaker has only one operating handle 34 to manually open or close all phases. If one phase of the circuit breaker has locked contacts and the circuit breaker receives a signal to trip, the operating mechanisms of the two remaining phases will attempt to pull the third mechanism to the tripped position. The shuttle 78 will block the movement of a third handle arm 36 and all handle arms 36 will be generally in the ON position. A comparison of FIGS. 8 and 9 shows the limited movement of the handle arm 36 in the locked contact situation. By preventing the circuit breaker from being moved to the OFF position, the present invention also prevents the maintenance personnel from resetting the circuit breaker and returning it to the closed or ON position.

While the invention has particularly been shown and described with reference to a preferred embodiment, it will be understood by those skilled in the art that variations in form, construction and arrangement may be made without departing from the spirit and scope of the invention. All such variations are intended to be covered in the appended claims.

We claim:

1. A circuit breaker comprising:

separable contacts;

an operating mechanism for opening and closing said contacts having an associated operating handle, said operating mechanism normally opening said contacts after receiving a trip signal, said operating mechanism also opening and closing said contacts as a result of manual operation of said associated operating handle, and said operating mechanism including a shuttle means that is normally resiliently biased to a non-interfering position with said operating handle and is moved to an interfering position that blocks the manual opening movement of said operating handle upon the contacts remaining closed after said operating mechanism receives said trip signal.

2. A circuit breaker as claimed in claim 1 wherein said shuttle means is pivotally mounted, said shuttle means pivoting into said interfering position upon said contacts remaining closed after said operating mechanism receives a trip signal.

3. A circuit breaker as claimed in claim 2 wherein said operating mechanism includes a first member upon which said shuttle means is mounted, upon said operating mechanism receiving a trip signal, said first member moving a greater distance when said contacts open than when said contacts remain closed.

4. A circuit breaker as claimed in claim 3 further including a resilient member for causing said shuttle means to pivot upon said contacts remaining closed after said operating mechanism receives a trip signal.

5. A circuit breaker comprising:

separable contacts;

an operating mechanism for opening and closing said contacts having an operating handle, said operating mechanism normally opening said contacts after receiving a trip signal, said operating mechanism also opening and closing said contacts as a result of manual operation of said operating handle; and said operating mechanism including a shuttle that blocks the manual opening movement of said operating handle upon the contacts remaining closed after said operating mechanism receives said trip signal, wherein said shuttle is pivotally mounted and wherein a resilient member connects said shuttle to said operating mechanism.

6. A circuit breaker comprising:

separable contacts having an open position and a closed position;

an operating mechanism having open, closed and tripped positions, said operating mechanism closed position normally corresponding to said contacts closed position, said operating mechanism open position and tripped position normally corresponding to said contacts open position;

an operating handle manually movable between an open position and a closed position, the movement of said operating handle to said operating handle open position normally causing said operating mechanism to move to said operating mechanism open position; and a resiliently biased movable shuttle means for preventing the movement of said operating handle to said operating handle open position upon detecting simultaneously said contacts closed position and said operating mechanism tripped position.

7. A circuit breaker as claimed in claim 6 wherein said shuttle means is mounted on said operating mechanism.

8. A circuit breaker as claimed in claim 6 wherein said operating mechanism comprises an overcenter spring that opens said contacts upon manual movement of said operating handle to said operating handle open position.

9. A circuit breaker comprising:

separable contacts having an open position and a closed position;

an operating mechanism having open, closed and tripped positions, said operating mechanism closed position normally corresponding to said contacts closed position, said operating mechanism open position and tripped position normally corresponding to said contacts open position;

an operating handle manually movable between an open position and a closed position, the movement of said operating handle to said operating handle open position normally causing said operating mechanism to move to said operating mechanism open position; and a shuttle to prevent the movement of said operating handle to the open position upon detecting simultaneously the contacts closed position and the operating mechanism tripped position, wherein said shuttle is mounted on said operating mechanism and is moved by a resilient member upn the detection of the simultaneous contacts closed position and operating mechanism tripped position.

* * * * *